United States Patent [19]

Torrey

[11] 4,081,647

[45] Mar. 28, 1978

[54] ENERGY SEAL FOR A MICROWAVE OVEN

[75] Inventor: Sumner Hale Torrey, West LaFayette, Ind.

[73] Assignee: Roper Corporation, Kankakee, Ill.

[21] Appl. No.: 684,663

[22] Filed: May 10, 1976

[51] Int. Cl.[2] ..... H05B 9/06

[52] U.S. Cl. ..... 219/10.55 D; 174/35 MS

[58] Field of Search ..... 219/10.55 D, 10.55 F, 219/10.55 R, 506; 126/273 R; 174/35 R, 35 MS

[56] References Cited

U.S. PATENT DOCUMENTS

| | | | |
|---|---|---|---|
| 3,260,832 | 7/1966 | Johnson | 219/10.55 D |
| 3,629,537 | 12/1971 | Haagensen | 219/10.55 D |
| 3,668,357 | 6/1972 | Kobayashi | 219/10.55 D |
| 3,736,399 | 5/1973 | Jarvis | 219/10.55 D |
| 3,812,316 | 5/1974 | Milburn | 219/10.55 D |
| 3,846,608 | 11/1974 | Valles | 219/10.55 D |
| 4,013,861 | 3/1977 | Westfall | 219/10.55 D |

FOREIGN PATENT DOCUMENTS

| | | | |
|---|---|---|---|
| 47-49847 | 12/1972 | Japan | 219/10.55 D |

OTHER PUBLICATIONS

How Amana Keeps Oven Leakage to a Micro-Trickle, Appliance Manufacturer, 9-70, 6-12-74.

*Primary Examiner*—Arthur T. Grimley
*Attorney, Agent, or Firm*—David J. Richter

[57] ABSTRACT

An energy seal for a microwave oven including resilient and conformable primary and outboard seals encompassing a choke type secondary seal. The composite seal is particularly suited to "wide gap" configurations in that the resilient elements thereof are adapted to fill the gap, conforming to a wide range of gap and oven door fit tolerances. The primary seal is capacitive in nature and includes a woven metal mesh inner cylinder surrounded by a woven fiberglass dielectric cover, the arrangement tending to oppose compression thereby to fill the gap when compressed by closing of the oven door. The choke seal comprises a cavity of predetermined depth having an aperture into the gap; the effectiveness of the choke is increased by the outboard seal which presents a very small impedance to the transmission path formed in the gap following the secondary seal. The outboard seal may be a capacitive seal similar to the primary, or a metal to metal contact seal.

16 Claims, 7 Drawing Figures

ENERGY SEAL FOR A MICROWAVE OVEN

This invention relates to microwave ovens, and more particularly to an improved energy seal for minimizing the escape of microwave radiation from the oven cavity.

Energy seals of various configurations have been used in microwave ovens in the past with varying degrees of success. Typically, such seals are positioned in surrounding relationship to the access opening of the oven enclosure, in the interface between oven door and enclosure, for preventing the escape of energy through such interface. The prior art illustrates the use of sealing elements including those characterized as metal to metal contact seals, resonant or choke type seals operating on quarter wave or half wave chock theory, capacitive seals, and dissipative or lossy seals for absorbing microwave energy. While these seal types have been used in various combinations in microwave ovens, the prior art has not been completely successful in providing a seal which is both economical to manufacture and effective to reduce energy leakage to acceptable levels, especially when considering manufacturing tolerances and component variation introduced by sustained use. For example, microwave energy seals known heretofore have generally required rather close tolerances in the fit between the oven door and oven cavity in order to form an effective seal. In many cases, introduction of a foreign object into the seal, either metallic or dielectric, causes excessive, and potentially dangerous leakage.

The prior art has recognized the effectiveness of metal to metal contact type energy seals. However, in practice such seals generally require a rather closely toleranced fit between the door and cavity so as to maintain a continuous contact around the entire periphery of the access opening. If continuous contact is not maintained, arcing results causing damage to the seal and leakage of radiation. It has also been proposed (as illustrated in U.S. Pat. Nos. 3,459,921 to Fussell et al. and 3,812,316 to Milburn) to use a metal to metal seal which is conformable to fit variations in the over-enclosure interface. While this approach attacks one facet of the metal to metal contact seal problem, there still remains the problem of providing an electrically conductive metallic surface around the entire periphery of the oven to mate the seal, and of keeping both the seal and the last mentioned metallic surface clean so as to provide a uniform electrical contact around the entire periphery of the access opening.

Capacitive seals have also been used in microwave ovens as illustrated by U.S. Pat. No. 3,736,399 to Jarvis. While the capacitive seal shown therein is said to be resilient, it is formed of a thin metallic sheet, and, while maintaining a degree of resiliency, cannot be said to be "conformable" as that term will be used herein. U.S. Pat. No. 3,666,904 to Krajewski shows a capacitive seal including a biased thin metallic sheet; as in Jarvis the degree of resiliency or conformability is limited.

Choke seals, because of transmission path length and width restrictions, have generally required close tolerances in the over-enclosure fit in order to maintain their effectiveness. Finally, lossy seals, while being adapted to absorb and dissipate the radiation, are rather expensive, are able to tolerate only a limited temperature range, and thus contribute excessively to the overall cost of the microwave oven. Furthermore they are most effective when positioned in close proximity to one of the enclosure members, again requiring close tolerances. In many cases, lossy seals are used as outboard elements to compensate for primary seals of limited effectiveness.

In addition to the aforementioned limitations, energy seals known heretofore have generally required a complete design or redesign of the door-enclosure interface in order to achieve the necessary tolerances and element interrelationships. In line with a recent interest in common cavity cooking, that is cooking in an oven having both a conventional radiant energy source and a microwave source, designers of conventional ovens who desire to add a microwave capability are faced with the problem of providing an energy seal in their standard oven configurations. Many of these ovens are characterized by a relatively "wide gap" door-enclosure fit, entirely suitable for conventional cooking, but posing problems in sealing radiation into the oven cavity in microwave use. Since the majority of microwave oven energy seals known heretofore have required a rather narrow gap between the oven and door, they are not compatible with common cavity cooking ovens, which due to their size, warpage caused by the processing of fired-on porcelain finishes, and thermal distortion in cooking use, require "wide gap" door-enclosure fit, with large tolerances.

In view of the foregoing, it is a general aim of the present invention to provide a microwave sealing system which is compatible with the thermal environment of conventional and pyrolytic ovens, more specifically, being adaptable to "wide gap" oven configurations and being effective to limit microwave energy leakage to acceptable levels. In this regard, it is an object of the present invention to provide a three element seal including inboard and outboard resilient seals, adapted to conform to the wide gap, encompassing a secondary seal. Thus, it is a resulting object to provide an energy seal for a conventional oven which requires minimum redesign and retooling of the oven and door.

Another object of the present invention is to provide an energy seal including a primary seal which is conformable and capacitive. In that regard, it is a more detailed object to provide such primary seal having a metallic inner layer encompassed by a dielectric layer, such seal being compressable but serving to resist compression so as to fill the gap between the oven door and enclosure when the door is closed. An even more detailed object is to provide such a seal which is operative in conjunction with oven doors and oven enclosures having standard interior finishes such as enamel, porcelain or the like. In that regard, it is an object to use the enamel or porcelain of the oven door and oven cavity as a dielectric in such capacitive seal.

According to another aspect of the invention, it is an object to seal energy within a microwave oven using an improved composite seal suited to wide gap configurations including a secondary choke seal and a final seal, outboard of the choke, for increasing the effectiveness of the choke by presenting a very small impedance to the transmission path following the choke seal. A further detailed object is to provide such an outboard seal which is resilient and conformable in nature.

Finally, an object of the present invention is to provide a microwave energy seal which is not defeated by insertion of foreign objects such as metallic objects (e.g. cooking utensils) or dielectric objects (e.g. paper towels).

Other objects and advantages will become apparent from the following detailed description, when taken in conjunction with the drawings, in which.

Figure 2:
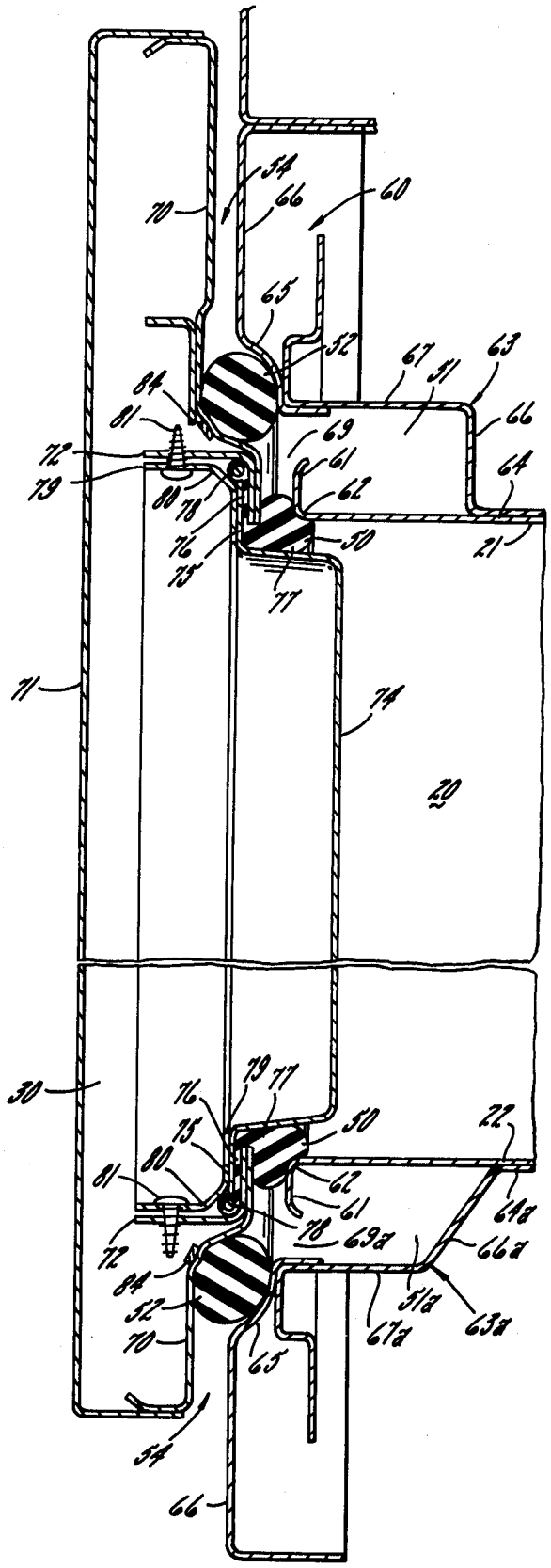
FIG. 2 is a vertical cross section taken along the lines 2—2 of FIG. 1 and showing the door-enclosure interface and the energy seal.
Figure 4:
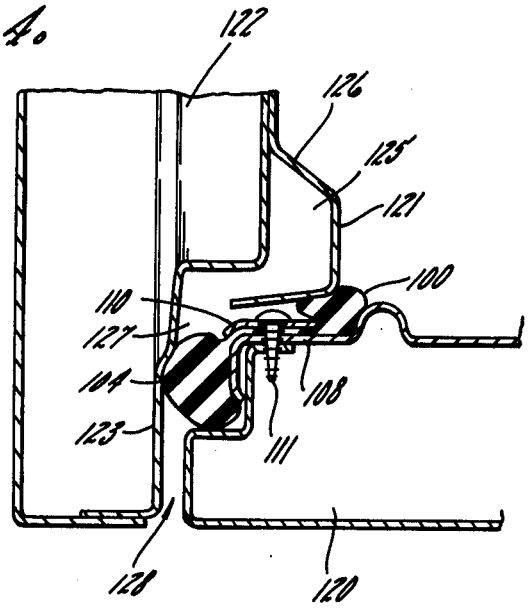
Figure 5:
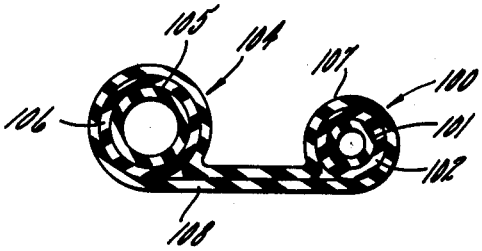

FIGS. *3a–3c* are partial views illustrating the resilient sealing members of FIG. 2;

FIG. 4 is a partial sectional view, similar to FIG. 2, showing a modified door-enclosure interface illustrating an alternative configuration of energy seal including a two bulb unitary construction; and FIG. 5 is a sectional view showing the two bulb unitary sealing element of FIG. 4.

While the invention will be described in connection with certain preferred embodiments, it will be understood that there is no intent to limit it to those embodiments. On the contrary, the intent is to cover all alternatives, modifications and equivalents included within the spirit and scope of the invention as defined by the appended claims.

Figure 1:
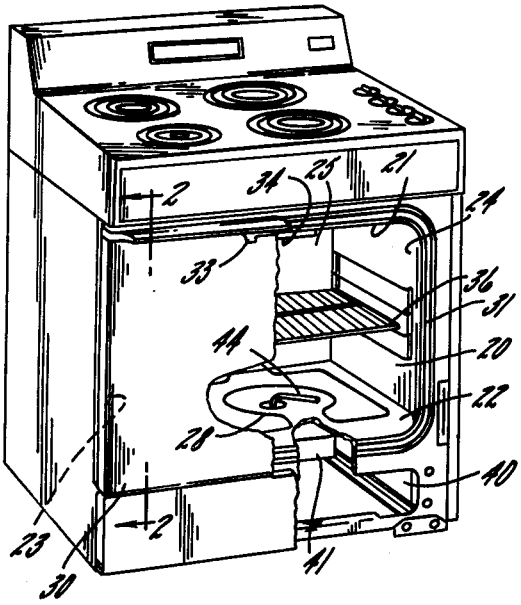
FIG. 1 is a perspective view of a free standing electric range of conventional design but incorporating a source of microwave energy and having provision for use of thermal and microwave energy simultaneously in a common oven cavity.

Turning now to the drawings FIG. 1 shows a typical free standing electric range incorporating a source of microwave energy and schematically illustrating the use of an energy seal according to the present invention. The range has an oven cavity 20 formed by an enclosure including a top wall 21, a bottom wall 22, side walls 23, 24 and a back wall 25. Spaced downwardly a short distance from the top wall 21 is a heating element (not shown). A second heating element 28 is spaced a short distance above the bottom wall 22. The front access opening of the oven is closed by a hinged door 30. An energy seal, indicated schematically at 31, completely surrounds the oven enclosure at the door-enclosure interface and provides both temperature sealing for pyrolytic cleaning and energy sealing to prevent leakage of microwave radiation. A door latch 33 operating in conjunction with a latch control 34 is provided to interlock the microwave and pyrolytic controls of the oven to assure that the oven door is properly closed before such capabilities may be activated. The latch 33 engages the latching control 34 to firmly draw the oven door to the oven enclosure, assuring a tight seal before the interlocking circuitry allows operation of the oven. Within the oven cavity is a grid type shelf 36; it will be understood that more than one such shelf may be used, if desired.

Conveniently located below the oven cavity in a storage space 40 is a module 41 adapted to function as a source of microwave energy. As is well known, such microwave source generally comprises a magnetron for supplying microwave energy at a particular frequency to be used in cooking food-stuffs placed in the oven cavity. For distributing the microwave energy to the oven cavity, an antenna 44 has its feed end electrically coupled to the microwave source and its distribution end projecting into the oven cavity. The particular antenna illustrated is of the rotating type, being rotated from its central axis at a relatively low rate (such as 3 or 4 rpm.) to couple and evenly distribute microwave energy from the magnetron into the oven cavity.

It should be noted at this point that the electric range described above merely illustrates a typical environment for an energy seal according to the present invention. Accordingly, it will be appreciated that the energy seal according to the invention may be applied to the illustrated oven as well as numerous variations thereof, including portable configurations.

Turning now to FIG. 2, there is shown in greater detail the energy seal schematically illustrated in FIG. 1. It is noted, however, that for ease of illustration, the primary and outboard sealing elements are shown somewhat schematically, the actual construction being shown in detail in FIGS. *3a–3c*.

In accordance with the invention, such seal comprises an inboard conformable capacitive seal 50, a secondary choke seal 51 and an outboard seal 52 adapted to lower the impedance of the transmission path following the secondary seal, the composite seal being positioned in the irregular gap 54 formed between the oven door 30 and the oven enclosure. As will be described in more detail below, the primary seal 50 is capacitive in nature and is positioned proximate the oven cavity thereby to present a capacitive impedance across the oven-enclosure gap at its initiation so that the major portion of the energy attempting to escape the cavity is blocked. The choke 51 is positioned outboard of the capacitive seal and serves to absorb the energy passing the primary seal 50. For increasing the effectiveness of the choke 51 the outboard seal 52 presents a very small impedance to the transmission path following the secondary seal. Absent this small impedance in the outboard transmission path, the choke 51 would be less effective and unwanted energy would pass the composite seal. This is due to the fact that in reality an open circuit does not occur outboard of the choke, nor does a transformed half wave choke or the primary capacitance seal truly result in a short circuit at the door-enclosure interface. In the illustrated embodiment the outboard seal 52 comprises a capacitive seal similar to the primary seal 50; however, because of the low energy levels at the secondary seal, it also is possible to use a metal to metal contact seal, without the arcing problems inherent in using such seal as the primary sealing element.

Turning to the structure of the exemplary embodiment in greater detail, it is seen that the walls of the oven (top wall 21 and bottom wall 22 being illustrated) are extended and bent to form flange like projections generally indicated at 60 facing the oven door 30. The flanges 60 are of composite construction in the illustrated embodiment, including first flange member 61 formed of an extension of the top, bottom and side walls and having a radiused corner 62 adapted to engage the primary seal 50. The flange 60 further includes a second element 63 secured to the top, bottom and side walls at 64 as by welding, and including a concave portion 65 positioned to engage the outboard seal 52 and a generally perpendicular portion 66 forming the upstanding face of the flanged portion of the enclosure. Referring to the flange member 63 illustrated in the upper portion of FIG. 2, it is seen that such member includes two right angles bent to form the cavity 51 including shorting wall 66 and side wall 67. The cavity 51 has an aperture 69 opposite the shorting wall 66 opening into the gap 54, such aperture being formed between the termination of flange portion 61 and the seat 65 for the outboard seal. The back or shorting wall 66 is spaced a predetermined distance behind the aperture 69, typically a distance equal to a quarter wavelength of the operating frequency of the magnetron, although a half wavelength choke may also be used. The resonant cavity 51*a* illustrated in the lower portion of FIG. 2 shows an alternative configuration wherein the flange member 63*a* is attached to the wall 22 at 64*a* as by welding, and is bent at acute angles to form a side wall 67*a* similar to wall 67 and an angled shorting wall 66*a*. While such a resonant cavity may be more difficult to fabricate, it has certain beneficial electrical properties, such as a broader effective frequency range, as will be described in more detail below. Additionally, it should be noted that while both forms of resonant cavity 51 and 51*a* are shown on the same embodiment, the normal practice will be to use only one of such configurations around the entire periphery of the oven cavity.

The door 30 is formed on an annular frame member 70 which, in the closed position, faces the flange member 60 of the cavity to form the irregular gap 54. The door includes an exterior metallic sheet 71, typically enameled, attached to the frame 70. Also affixed to the frame 70 is an angled annular bracket portion 72 which provides a mounting surface for the primary seal and the internal door wall. It is seen that the internal door wall 74 is pan-like in configuration and includes an angled portion 75 overlying an extended portion 76 of the primary seal 50. The primary seal 50 includes a cylindrical portion 77 and the aforementioned extended portion 76. Further, to securely maintain the primary seal in its position, a minor bulbous portion 78 may be formed by filling the rearmost portion of the primary seal with a fill such as fiberglass rope or the like. Alternatively, the portion 78 may be formed of an aluminum wire bent into the shape of the annular crevice into which it fits so as to facilitate installation of the primary seal. An angled bracket 79, preferably having a relieved portion 80 for fitting the expanded portion 78 of the primary seal, is secured to the bracket 72 as by screws 81. It is seen that this arrangement securely locks both the pan type inner wall 74 and the primary seal 50 into position so that the primary seal 50 is compressed between the radiused corner 62 of flange 61 and the pan 74 when the door 30 is moved to its closed position. The outboard seal 52 is also secured to the frame member 70 of the door, such as by clips 84 engaged in suitable apertures in the frame 70 so that the outboard seal 52 is compressed between the mating concave portions when the door is moved to its closed position.

Figure 3A:
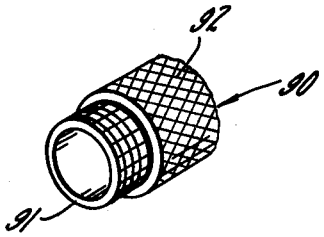
Figure 3B:
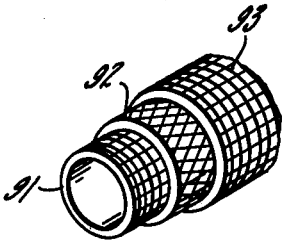
Figure 3C:
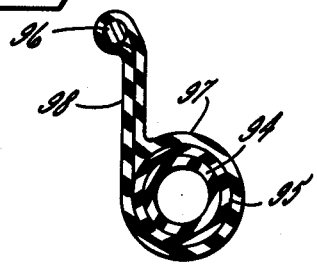

Focusing on FIGS. 3*a* through 3*c*, there are shown various configurations of sealing elements usable in the oven door energy seal of FIG. 2. FIG. 3*a* illustrates the basic sealing element 90 comprising a conductive element surrounded by a dielectric element, shown herein as inner metallic layer 91 encompassed by outer dielectric layer 92. The inner metallic layer 91 is a hollow tube formed of conductive woven metal mesh, such as Inconel or non-magnetic stainless steel forming a springy metal tube which is compressible, but which tends to resist compressive forces. Surrounding the metal mesh tube 91 is a jacket 92 formed of woven fiberglass or the like of a predetermined thickness, such fiberglass jacket serving as a dielectric in the capacitive seal. It will now be appreciated that interposing sealing member 90 in a door-enclosure interface will serve to compress the assemblage from its normal cylindrical shape, maintaining the inner metallic jacket at a predetermined distance from the metallic oven members (determined by the thickness of the fiberglass jacket), thus producing a highly conformable capacitive seal. In addition to these characteristics, both the fiberglass and the metal mesh are adapted to withstand temperatures well in excess of those normally encountered during pyrolytic cleaning of the oven.

FIG. 3*b* illustrates a sealing member similar to member 90, but further including an external metal mesh jacket 93 encompassing the fiberglass jacket 92 the outer metallic sleeve 93 forming a protective jacket for the capacitive seal. Because of its increased wear resistance the seal of FIG. 3*b* is particularly adapted for use as a primary seal, and is additionally self-cleaning during the normal pyrolytic cleaning of the oven. It should further be noted that the seals such as those illustrated in FIGS. 3*a* and 3*b* are particularly suited for use in conventional oven enclosures without special surface treatment in that the protective coatings normally found on the inside of such ovens, such as porcelain or baked enamel, are actually dielectrics and thus function as an element of the capacitive seal. For example, the sealing element of FIG. 3*b* not only includes a capacitor formed between the inner and outer metallic jackets wherein the fiberglass jacket is the dielectric, but also includes a capacitor formed between the outer jacket and the respective oven and door surfaces, wherein the porcelain layer is the dielectric.

FIG. 3c illustrates the details of the primary seal of FIG. 2 including an inner springy metallic tube of stainless steel mesh 94 encompassed by a woven fiberglass jacket 95. An aluminum wire 96, formed into the annular shape of the door opening, and the concentric tubes 94, 95 are encompassed by an outer protective metallic mesh jacket 97. The outer Inconel jacket 97 is crimped closely around the concentric tubes 94, 95 and around the aluminum wire 96, or stapled as needed, providing an elongated portion 98. It is recalled that such elongated portion mates a flanged portion of the inner door pan 74, the mounting bracket 80 securing such elements in position and capturing the aluminum wire 96 to maintain the primary seal in position. It should also be noted that either of the seals illustrated in FIG. 3*a* or 3*b* may be used as the secondary seal. However, realizing that the outboard seal is exposed to less wear, and for the purposes of economy, the seal of FIG. 3*a*, without the protective metal mesh cover is preferred in the embodiment of FIG. 2 as the outboard seal.

Comparison of FIG. 2 with FIGS. 3*a–c* demonstrates the operation of a composite seal according to the invention. FIGS. 3*a–c* show the seals in their expanded condition, such as would be assumed with the oven door in the open position. It is seen that the seals are expanded to substantially a cylindrical shape by virtue of the metal mesh springy tube at the interior thereof. Upon closing of the door (FIG. 2), both the primary and outboard seals are compressed, substantially completely filling the portion of the gap 54 which they occupy. The primary seal 50 mates the radiused portion 62 of the oven enclosure, and forces a portion of the seal into the door-enclosure interface proximate the oven cavity. The outboard seal is also compressed between the opposed concave portions of the oven door and oven enclosure, thereby to substantially fill the portion of the gap allotted to it. The main function of the outboard seal is to present a very small impedance to the transmission path formed in the gap following the secondary seal. Accordingly, the outboard seal may be either capacitive, or a metal to metal contact seal. However, it is preferred that a capacitive seal be utilized. The secondary seal 51 has its aperture 69 opening into the gap 54 intermediate the primary and outboard seals. The cavity 51 is dimensioned so that its length (from the aperture 69 to the shorting wall 66) corresponds to one quarter wavelength of the frequency to be attenuated. However, if desired, the shorting wall of the resonant cavity may be tapered as shown at 51*a* of FIG. 2 so that the secondary choke seal is effective over a band of frequencies. It will be appreciated that this tapered construction can only be used with a very effective primary seal, such as the closely conforming capacitive seal taught herein.

Turning finally to FIGS. 4 and 5, there is shown an alternate configuration of energy seal wherein the sealing elements are formed into a unitary subassembly thereby to effect certain economies of manufacture. As shown in FIG. 5, the primary seal 100 includes an inner stainless steel mesh jacket 101 surrounded by fiberglass jacket 102. The outboard seal 104 similarly includes a stainless steel mesh inner springy tube 105 surrounded by a fiberglass jacket 106. Encompassing both of such tubes is an outer protective jacket 107 of Inconel mesh. The outer mesh jacket is crimped or stapled adjacent the primary and outboard bulbs forming two bulbous portions 100, 104 joined by a center flattened piece 108. Such a seal may be positioned as a unit in an oven configuration having a door-enclosure interface as shown in FIG. 4 by simply overlying the flattened piece 108 with a metal mounting member 110, and securing such mounting member as by screws 111. FIG. 4 shows the dual bulb configuration being carried on the inside of the oven structure 120 with the primary seal adapted to engage a flanged portion 121 of the oven door 122 while the secondary seal engages a generally perpendicular portion 123 of the oven door 122. The resonant choke 125 is illustrated having a tapered back wall 126 and including an aperture 127 opened to the gap 128 between the oven and door. FIG. 4 thus illustrates one of the many alternative configurations to which the energy seal according to the invention may be applied. It is noted that both the FIG. 2 and FIG. 4 embodiments show door-enclosure interfaces with relatively wide gaps, such as those normally encountered in conventional cooking ranges. It will now be apparent that the energy seal according to the invention is easily adaptable to numerous of such configurations thereby to allow conversion to microwave heating with a minimum of redesign and retooling, while allowing the use of a "wide gap" transmission path.

I claim as my invention:

1. In a microwave oven having an enclosure forming a cavity with an access opening into said cavity, a hinged door for closing said access opening, said door in its closed position mating said enclosure and forming a gap at the door-enclosure interface surrounding said access opening, said door-enclosure interface having an enclosure-interface surface and a door-interface surface, a source of microwave energy, means supplying said microwave energy to said cavity, and an energy seal coextensive with the door-enclosure interface surrounding said access opening; wherein the improvement comprises: the energy seal comprising in combination, a primary, tube-like capacitive seal positioned in the gap in said door-enclosure interface proximate said cavity, said capacitive seal including an inner metallic layer encompassed by an outer dielectric layer, said layers being compressible but exerting an outward force when compressed so that said primary seal conforms to and fills a portion of the gap in the door-enclosure interface, a secondary choke seal comprising a cavity of predetermined depth having an aperture into said gap outboard of said capacitive seal, resilient outboard seal means positioned outboard of said choke seal for presenting a very small impedance to the transmission path following said secondary seal, and means for biasing the door toward the enclosure in the door closed position, whereby closing of said door serves to compress said primary and outboard seals, causing said primary and outboard seals to conform to said gap encompassing said secondary seal thereby to minimize leakage of microwave energy from said cavity.

2. The energy seal as set forth in claim 1 wherein the inner layer of said primary seal comprises a woven metal mesh tube, said tube being deformable but exerting an outward force when deformed to return to its cylindrical shape.

3. The energy seal as set forth in claim 2 wherein the outer layer of said primary seal comprises a woven fiberglass tube encompassing said metal mesh tube.

4. The energy seal as set forth in claim 3 further including a metal mesh jacket encompassing said woven fiberglass tube, thereby to increase the resistance to wear of said primary seal.

5. The energy seal as set forth in claim 3 wherein the primary seal further includes a woven metallic jacket encompassing said fiberglass tube and having a flattened portion of said jacket extending from said fiberglass tube, wire means formed in the shape of said access opening and positioned within said jacket opposite said fiberglass tube, said oven door including means for clamping said flattened portion and said wire means to said door, thereby to fix said primary seal to said door.

6. The energy seal as set forth in claim 1 further including a woven metallic jacket encompassing said primary seal, thereby to increase the resistance to wear of said primary seal and the primary seal being affixed to one of the door-interface surface and the enclosure-interface surface and a dielectric coating being affixed to the other of the door-interface surface and the enclosure-interface surface over the area of contact of the primary seal, whereby the dielectric coating prevents electrical contact between the jacket and said other surface.

7. The energy seal as set forth in claim 6 wherein said oven further includes radiant heating means operable in a pyrolytic cleaning mode, said metallic and dielectric layers of said primary seal being resistive to the oven temperatures produced by said radiant heating element during pyrolytic cleaning.

8. The energy seal as set forth in claim 7 wherein said primary seal is exposed directly to the temperature within said cavity, thereby to be cleaned during the pyrolytic cleaning process.

9. The energy seal as set forth in claim 1 wherein the microwave oven further includes latch means for locking said door into a closed position, said latch means serving to draw said door toward said enclosure thereby to compress said primary and outboard seals.

10. A microwave oven comprising in combination, an enclosure including top, bottom, side and rear walls forming a cooking cavity having an access opening in the front thereof, a door operable between a closed position over said access opening and an open position, a source of microwave energy, means supplying said microwave energy to said cavity, said top, bottom and side walls including flange portions forming an annular flange surrounding said access opening, said door having a portion facing said annular flange when in the closed position and forming a gap between said door and enclosure, a primary energy seal interposed in said gap proximate said cavity, said primary energy seal including conductive means surrounded by dielectric means interposed between the oven door and flange means for forming a capacitance across the transmission path formed by said gap, said primary seal being resilient but tending to oppose compression so that closing of said door causes said primary seal to closely conform to the gap filling the portion of said gap proximate said cavity, resilient outboard seal means interposed in said gap outboard of said primary seal for presenting a very small impedance to the transmission path formed in said gap, and choke means comprising a cavity having a predetermined depth and an aperture into said gap interposed between said primary and outboard means.

11. In a microwave oven having an enclosure forming a cooking cavity, a door operable between an open position to allow access to said cavity and a closed position to close said cavity, said door in its closed position forming a gap between the enclosure and door and providing an enclosure-interface surface and a door-interface surface at the door-enclosure interface and an energy seal coextensive with the door-enclosure interface, wherein the improvement comprises: the energy seal comprising in combination, a conformable capacitive tube-like primary seal positioned in the gap proximate said cavity, said primary seal including an inner metallic layer encompassed by a dielectric layer, said primary seal being compressible but serving to resist compression thereby to fill the gap proximate the cavity when the door is in its closed position, a secondary choke seal outboard of said primary seal, said secondary seal including a cavity of predetermined depth having an aperture into the gap outboard of the primary seal, and outboard seal means positioned outboard of the secondary seal for presenting a very small impedance to the transmission path formed in said gap thereby to increase the effectiveness of said secondary seal.

12. The energy seal as set forth in claim 11 wherein the outboard seal means comprises a woven metal mesh tube encompassed by a dielectric sleeve, said outboard seal being compressible, but serving to resist compression thereby to fill the portion of the gap outboard of said secondary seal when the door is in its closed position.

13. The energy seal as set forth in claim 12 further including a woven metal mesh jacket encompassing said primary and outboard seals, said jacket including a flattened portion joining said primary and outboard seals, and means overlying said flattened portion for mounting said seals in position within said gap.

14. The energy seal as set forth in claim 11 wherein the primary seal further includes an outer jacket of woven metal mesh, and said enclosure -interface surface and said door-interface surface having a dielectric coating affixed thereto to the areas thereof contacting the primary seal in the door-closed position, whereby the dielectric coating is interposed between the outer jacket and the door and enclosure respectively.

15. The energy seal as set forth in claim 11 wherein the oven further includes a latch for locking the door in its closed position, said latch serving to draw the door toward the enclosure thereby to compress the primary and outboard seals in encompassing relationship to said secondary seal, thereby to effectively seal the microwave energy within said cavity.

16. The energy seal as set forth in claim 11 wherein the cavity of said secondary seal includes a side wall and a shorting wall, said shorting wall being angled with respect to said aperture whereby said secondary seal is effective over a band of frequencies.

* * * * *